US006375442B1

(12) United States Patent
Ward et al.

(10) Patent No.: US 6,375,442 B1
(45) Date of Patent: Apr. 23, 2002

(54) SUPERCHARGER CLUTCH SYSTEM

(75) Inventors: Lyle Ward, Royal Oak; Paul L. Maceroni, Clinton Township; Otis Olson, Farmington Hills, all of MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/502,414

(22) Filed: Feb. 10, 2000

(51) Int. Cl.[7] ..... F04C 29/00
(52) U.S. Cl. ..... 418/69; 192/91 A; 192/109 R
(58) Field of Search ..... 418/69; 123/559.3; 192/91 A, 109 R

(56) References Cited

U.S. PATENT DOCUMENTS 3,145,816 A * 8/1964 De Lorean et al. ..... 192/91 A
4,573,561 A * 3/1986 Deem et al. ..... 192/91 A
4,875,454 A * 10/1989 Okimoto et al. ..... 123/559.3
5,261,517 A * 11/1993 Hering ..... 192/91 A
5,586,636 A * 12/1996 Linnig ..... 192/91 A

FOREIGN PATENT DOCUMENTS

GB 2251041 * 6/1992 ..... 192/91 A

* cited by examiner

*Primary Examiner*—John J. Vrablik
(74) *Attorney, Agent, or Firm*—L. J. Kasper

(57) ABSTRACT

A supercharger clutch system has a clutch housing (52) in which a clutch pack (84) is disposed to transmit torque from an input, such as a pulley (66), to one of the timing gears (58). The clutch pack (84) is disposed within a cage (92), having a spring seat member (98) adjacent thereto. A set of springs (104) biases the seat member and the clutch cage (92) to engage the clutch pack (84). On the opposite side, axially, of the clutch pack there is a piston (76) including a portion (80) surrounding the clutch cage (92) and engaging the seat member (98). The piston (76) and the clutch housing (52) define a pressure chamber (106) which, when pressurized, causes movement of the piston in a direction compressing the springs (104) and disengaging the clutch pack. With the invention, the clutch system can be operated by engine lubrication oil, while still achieving rapid engagements (short response time), wherein the rate of engagement can be modulated to suit vehicle operating conditions.

5 Claims, 5 Drawing Sheets

SUPERCHARGER CLUTCH SYSTEM

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to a rotary blower, such as a supercharger for supercharging an internal combustion engine. More particularly, the invention relates to a supercharger having a fluid pressure operated clutch assembly adapted to transmit torque from an input to the supercharger rotors.

Although the present invention may be used advantageously with superchargers having various rotor types and configurations, such as the male and female rotors found in screw compressors, it has been developed for use with a Roots Blower supercharger, and will be described in connection therewith.

As is well known to those skilled in the art, the use of a supercharger to increase or "boost" the air pressure in the intake manifold of an internal combustion engine results in an engine having greater horsepower output capability than would occur if the engine were normally aspirated, (i.e., if the piston would draw air into the cylinder during the intake stroke of the piston). However, the conventional supercharger is mechanically driven by the engine, and therefore, represents a drain on engine horsepower whenever engine boost is not required. For the above and other reasons, it has been known for several years to provide some sort of engageable/disengageable clutch assembly disposed in series between the input (e.g., a belt driven pulley) and the blower rotors.

The assignee of the present invention has sold superchargers commercially including such clutch assemblies which operate electromagnetically. Unfortunately, the ON-OFF characteristics of electromagnetic clutches produce a transient load torque on the engine. For example, as the electromagnetic clutch is engaged, the result will be a "droop" in engine speed which will likely be perceived by the driver and maybe manifested as an undesirable slowing down of the vehicle.

It is also known to provide a fluid pressure operated clutch assembly in which the clutch pack is spring biased toward a disengaged condition, and is moved toward an engaged condition in response to axial movement of a fluid pressure actuated piston member. In other words, the known supercharger clutch is of the "pressure-applied, spring-released" type. Although a supercharger with such a clutch arrangement can operate in a generally satisfactory manner, once the clutch is in either the engaged or the disengaged condition, the known arrangement does involve certain disadvantages during "transient" conditions, i.e., as the clutch assembly changes from the disengaged condition to the engaged condition, or vice versa. By way of example, a known supercharger clutch assembly of the pressure applied, spring released type requires a fairly long piston travel in order to achieve engagement of the clutch pack (or very high apply pressure), thus requiring substantial flow of fluid to accomplish the required piston movement.

Although such a high flow requirement is not a problem, once the engine has reached normal operating temperature, it frequently occurs that engagement of the clutch assembly is required soon after "cold engine start up", while the engine oil is still cold. As a result, the known pressure applied, spring released system will have substantially longer time of engagement when the engine is cold than when the engine is warm, By way of example only, a typical engagement or release response time, as specified by the vehicle manufacturer, would be in the range of about 0.10 seconds. A substantially longer response time would result in the well known "turbo lag" feeling wherein the operator depresses the accelerator, but then there is a time lag before engine boost becomes noticeable, as is inherent in a turbocharger type of engine boost system. On the other hand, response time should not be so fast (when engaging) and so sudden as to result in a large torque spike being imposed upon the engine.

Another disadvantage associated with the pressure-applied type of supercharger clutch is that the oil pressure typically used is the engine lubrication oil circuit. As a result, the fluid pressure available to engage the clutch may be only in the range of about 20 psi., and even that very low pressure may not be available on a sufficiently consistent and predictable basis to be relied upon for engagement of the supercharger clutch, especially within the specified response time.

BRIEF SUMMARY OF THE INVENTION

Accordingly, it is an object of the present invention to provide an improved supercharger and clutch assembly which overcome the above-described disadvantages of the prior art.

It is a more specific object of the present invention to provide an improved supercharger and clutch assembly which accomplishes the above-stated object, and which has both a variable and a controllable engagement and disengagement response time, thus avoiding both transient overloading of the engine and a time lag upon engagement.

It is a further object of the present invention to provide such an improved supercharger and clutch assembly which operates in a consistent manner, substantially independent of variables such as engine oil temperature.

The above and other objects of the invention are accomplished by an improved rotary blower of either the backflow or compression type comprising a housing assembly including a main housing and a clutch housing, the main housing defining a blower chamber. Blower rotor assemblies are disposed in the blower chamber for effecting transfer of volumes of fluid in response to rotation of an input shaft. One of the blower rotor assemblies is operably mounted on a rotor shaft and has an input hub portion disposed adjacent the input shaft. A clutch assembly is disposed in the clutch housing and in driven relationship with the input shaft, and in driving relationship with the input hub portion, the clutch assembly being selectively operable between an engaged condition, operable to transmit torque from the input shaft to the input hub portion, and a disengaged condition.

The improved rotary blower is characterized by the clutch assembly including a first set of clutch disks fixed for rotation with the input shaft and a second set of clutch disks fixed for rotation with the input hub portion. A biasing means normally biases the first and second sets of clutch disks toward the engaged condition. A piston member cooperates with the clutch housing to define a pressure chamber, the piston member being axially moveable, in response to the presence of relatively high pressure fluid in the pressure chamber to a position releasing the biasing means and permitting the clutch assembly to move to the disengaged position. A valve means is operably associated with the clutch housing and is operable to communicate the pressure chamber to a source of relatively low pressure fluid in response to an electrical input signal having a first condition, and to a source of relatively high pressure fluid in response to the electrical input signal having a second condition.

DETAILED DESCRIPTION OF THE PREFERRED EMBODIMENT

Figure 1:
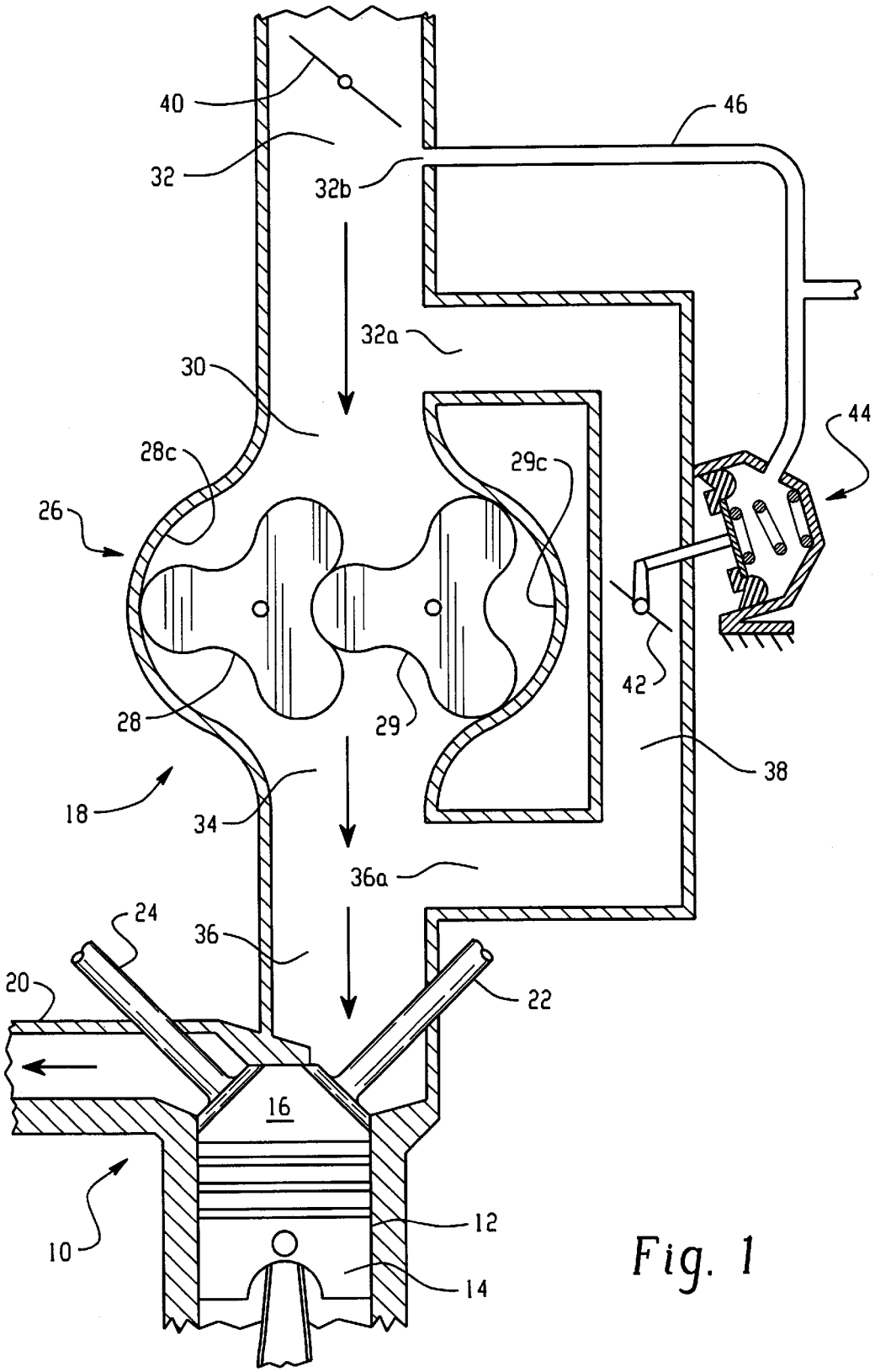
FIG. 1 is a schematic illustration of an intake manifold assembly having disposed therein a supercharger of the type which may utilize the present invention.

Referring now to the drawings, which are not intended to limit the invention, FIG. 1 is a schematic illustration of an intake manifold assembly, including a Roots blower supercharger and bypass valve arrangement of the type which is now well known to those skilled in the art. An engine, generally designated 10, includes a plurality of cylinders 12, and a reciprocating piston 14 disposed within each cylinder, thereby defining an expandable combustion chamber 16. The engine includes intake and exhaust manifold assemblies 18 and 20, respectively, for directing combustion air to and from the combustion chamber 16, by way of intake and exhaust valves 22 and 24, respectively.

The intake manifold assembly 18 includes a positive displacement rotary blower 26 of the backflow or Roots type, as is illustrated and described in U.S. Pat. Nos. 5,078,583 and 5,893,355, assigned to the assignee of the present invention and incorporated herein by reference. The blower 26 includes a pair of rotors 28 and 29, each of which includes a plurality of meshed lobes. The rotors 28 and 29 are disposed in a pair of parallel, transversely overlapping cylindrical chambers 28*c* and 29*c*, respectively. The rotors may be driven mechanically by engine crankshaft torque transmitted thereto in a known manner, such as by means of a drive belt (not illustrated herein). The mechanical drive rotates the blower rotors at a fixed ratio, relative to crankshaft speed, such that the blower displacement is greater than the engine displacement, thereby boosting or supercharging the air flowing to the combustion chambers 16.

The supercharger or blower 26 includes an inlet port 30 which receives air or air-fuel mixture from an inlet duct or passage 32, and further includes a discharge or outlet port 34, directing the charged air to the intake valves 22 by means of a duct 36. The inlet duct 32 and the discharge duct 36 are interconnected by means of a bypass passage, shown schematically at 38. If the engine 10 is of the Otto cycle type, a throttle valve 40 preferably controls air or air-fuel mixture flowing into the intake duct 32 from a source, such as ambient or atmospheric air, in a well known manner. Alternatively, the throttle valve 40 may be disposed downstream of the supercharger 26.

Disposed within the bypass passage 38 is a bypass valve 42 which is moved between an open position and a closed position by means of an actuator assembly, generally designated 44. The actuator assembly 44 is responsive to fluid pressure in the inlet duct 32 by means of a vacuum line 46. Therefore, the actuator assembly 44 is operative to control the supercharging pressure in the discharge duct 36 as a function of engine power demand. When the bypass valve 42 is in the fully open position, air pressure in the duct 36 is relatively low, but when the bypass valve 42 is fully closed, the air pressure in the duct 36 is relatively high. Typically, the actuator assembly 44 controls the position of the bypass valve 42 by means of suitable linkage. Those skilled in the art will understand that the illustration herein of the bypass valve 42 is by way of generic explanation and example only, and that, within the scope of the invention, various other bypass configurations and arrangements could be used, such as a modular (integral) bypass or an electronically operated bypass, or in some cases, no bypass at all.

Figure 2:
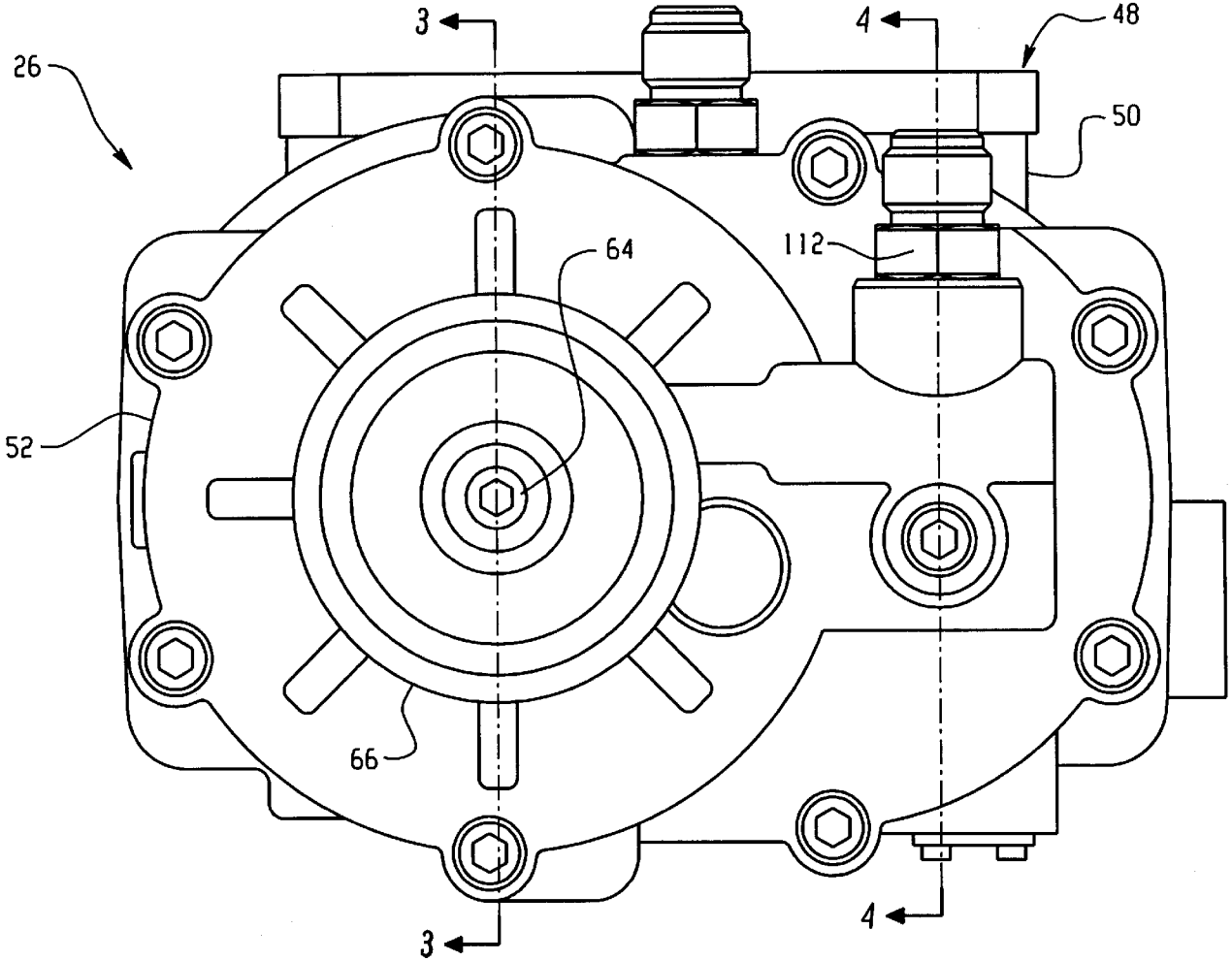
FIG. 2 is a front plan view of the supercharger shown schematically in FIG. 1.
Figure 3:
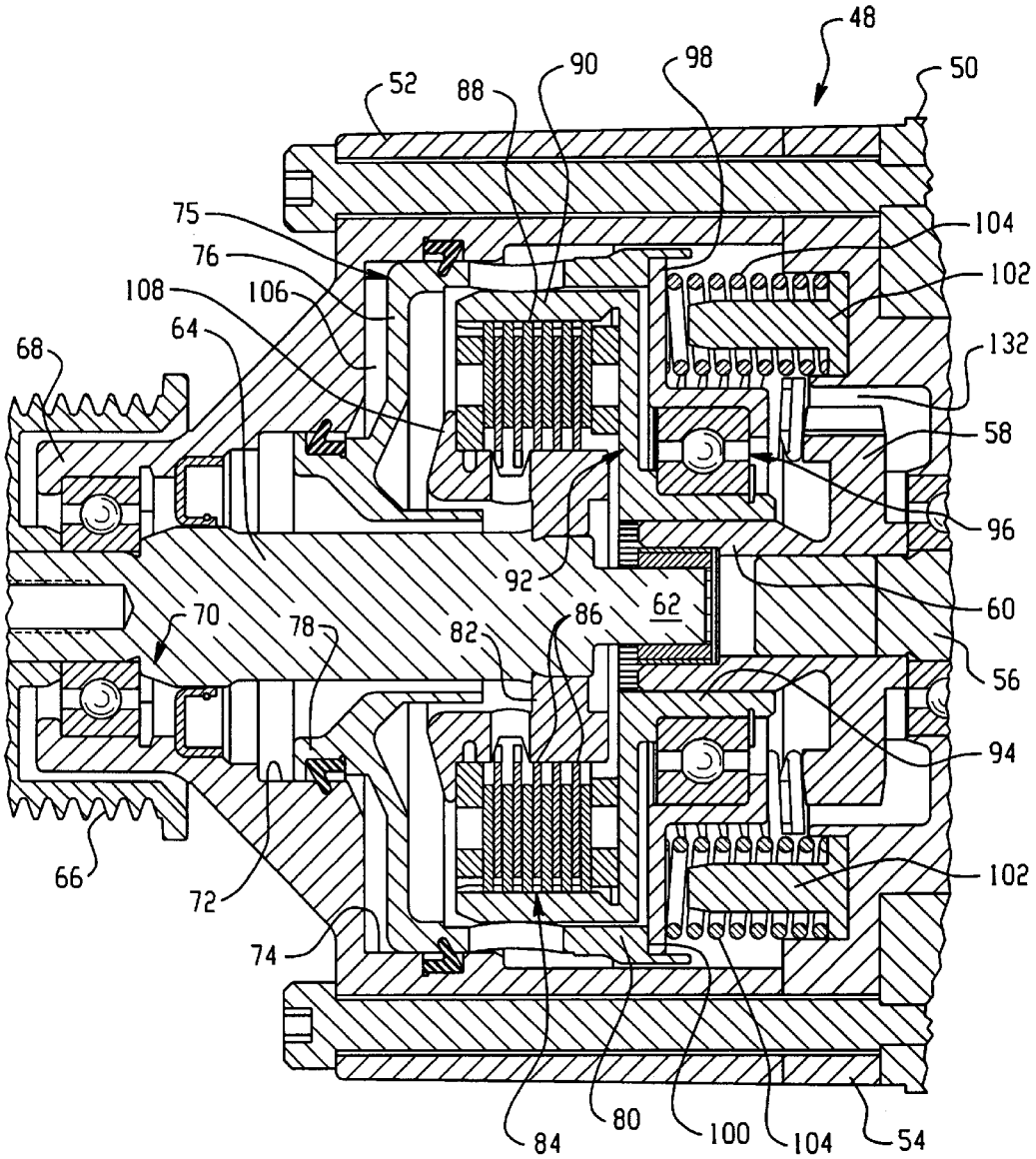
FIG. 3 is an enlarged, fragmentary, axial cross-section taken on line 3—3 of FIG. 2, and showing primarily the clutch assembly of the present invention, in its engaged condition.

Referring now primarily to FIGS. 2 and 3, the blower 26 includes a housing assembly generally designated 48, which includes a main housing 50 (shown only fragmentarily in FIG, 3), which defines the chambers 28*c* and 29*c*. The housing assembly 48 also includes an input housing 52, also referred to hereinafter as a clutch housing. Disposed axially between the main housing 50 and the clutch housing 52 is a bearing plate 54 through which extends a forward end of a rotor shaft 56, on which is mounted the rotor 28.

As is well known to those skilled in the art of superchargers, a timing gear 58 is pressed onto the forward end of the rotor shaft 56, and in the subject embodiment, the timing gear 58 includes an input hub 60. Journalled within the forward end (left end in FIG. 3) of the input hub 60 is a reduced diameter portion 62 of an input shaft 64. Disposed about a forward end of the input shaft 64 is an input pulley 66, by means of which torque is transmitted from the engine crankshaft (not shown) to the input shaft 64. It should be noted that the input pulley 66 is shown only fragmentarily in FIG. 3. The input pulley 66 surrounds a reduced diameter portion 68 of the clutch housing 52, and disposed radially between the input shaft 64 and the portion 68 is a bearing set 70.

The clutch housing 52 defines a relatively smaller internal diameter 72, also referred to hereinafter as a cylindrical surface 72, and a relatively larger internal diameter 74, also referred to hereinafter as a cylindrical surface 74. The cylindrical surfaces 72 and 74 comprise a clutch chamber which will hereafter also bear the reference "74". Disposed within the clutch chamber 74 is a clutch assembly, generally designated 75, including a clutch piston 76, including a reduced diameter portion 78 which is in sealing engagement with the smaller cylindrical surface 72, and a larger cylindrical portion 80 which is in sealing engagement with the cylindrical surface 74.

A splined drive member 82 is in driven engagement with the input shaft 64 by any suitable means, such as a press-fit relationship. Surrounding the drive member 82 is a clutch pack, generally designated 84, including a set of internally splined clutch disks 86, which are in splined engagement with the drive member 82. Interleaved with the disks 86 is a set of externally splined clutch disks 88, which are in splined engagement with internal splines defined by a cylindrical portion 90 of a clutch housing or cage 92. The clutch cage 92 also includes a relatively smaller cylindrical portion 94 which is in a splined relationship with the input hub 60, such that there can be relative axial movement therebetween, for reasons which will become apparent subsequently. Therefore, whenever the clutch pack 84 is engaged, input torque is transmitted from the input pulley 66 through the input shaft 64 to the splined drive member 82, and from there through the clutch pack 84 to the clutch cage 92, and then through the timing gear 58 to the rotor shaft 56.

Disposed about the cylindrical portion 94, and in a press-fit relationship thereto, is a bearing set 96, and surrounding the bearing set 96 is a spring seat member 98 (also referred to hereinafter as a release plate), the outer periphery of the member 98 being in engagement with a rearward shoulder surface 100 of the cylindrical portion 80 of the clutch piston 76. The purpose of the above relationship of the spring seat member 98 and the clutch piston 76 will be described subsequently.

Seated against a forward surface of the bearing plate 54 is a plurality (of which two are shown in FIG. 3) of spring support members 102, each member 102 being surrounded by a coil compression spring 104, the forward end of each spring 104 being seated against the spring seat member 98. Disposed axially between the radially extending portion of the clutch housing 52 and the forward surface of the clutch piston 76 is an annular pressure chamber 106. Whenever relatively high pressure is communicated to the pressure chamber 106, the clutch piston 76 is moved rearwardly (to the right in FIG. 3) to a position in which the springs 104 are sufficiently compressed that the member 98 is disposed in contact with the forward end (left end in FIG. 3) of each of the support members 102. Thus, the members 102 also serve as travel "stops" for the springs 104 and the seat member 98.

As is used herein, the term "relatively high" pressure will be understood to mean high relative to the low pressure, or sump (reservoir) pressure which would be present in the pressure chamber 106 whenever the chamber 106 is drained, i.e., is communicated to a case drain region, such as that surrounding the timing gear 58 (and the other timing gear, not shown herein). However, it is also one important aspect of the invention that the "relatively high" pressure used to disengage the clutch pack 84 is preferably a pressure of only about 10 to 20 psi. (gauge). As was mentioned in the BACKGROUND OF THE DISCLOSURE, it is desirable to be able to operate the supercharger clutch using only the engine lubrication oil, for which the pressure would typically be about 20 psi. at the "end" of its flow path, which is where the supercharger clutch would be disposed.

When the piston 76 is moved to the right from the position shown in FIG. 3, the spring seat member 98 is also moved rearwardly, compressing the springs 104, as mentioned previously. With the springs 104 somewhat compressed, the clutch cage 92 is moved somewhat to the right in FIG. 3, and the loading of the clutch pack 84 is relieved sufficiently such that no substantial torque will be transmitted from the input shaft 64 to the clutch cage 92. In other words, no substantial input torque will be transmitted to the timing gear 58 or to the rotor shaft 56. Preferably, the unloading of the clutch pack 84 is sufficient to eliminate any "clutch drag", the presence of which would somewhat diminish the benefit of being able to de-clutch the supercharger.

In order to engage the clutch pack 84, and therefore, to drive the rotors of the supercharger, it is necessary to reduce the fluid pressure in the pressure chamber 106 from the relatively high pressure to a relatively low pressure (which could be sump or reservoir pressure). In the subject embodiment, the spring rate of the springs 104 has been selected such that, when the pressure in the chamber 106 is reduced to the relatively low pressure, the springs 104 will bias the seat member 98 forwardly (to about the position shown in FIG. 3) which, in turn, biases the bearing set 96 and the clutch cage 92 forwardly. Such forward movement of the radially extending wall of the clutch cage 92 will compress the clutch pack 84 against a radially extending lip 108 of the drive member 82.

Clutch Controls

It will be apparent to those skilled in the art that the time of engagement of the clutch assembly of the present invention is determined indirectly by the net force compressing the clutch pack 84. The compression force is determined by the fluid pressure in the pressure chamber 106, as it decreases from the relatively high pressure to a relatively low pressure. In connection with the development of the present invention, it has been determined that it is an important aspect of the present invention to be able to modulate the rate of engagement of the clutch pack 84, in accordance with various vehicle and engine operating parameters, i.e., to reduce the pressure in the chamber 106, to a desired level, and therefore engage the clutch pack more rapidly or more slowly, depending upon various predetermined conditions. For example, when the engine is operating under a "part throttle" condition, it is desirable to achieve a longer time of engagement, whereas when the engine is operating under a "full throttle" condition, it is acceptable to engage the clutch pack more rapidly.

Figure 4:
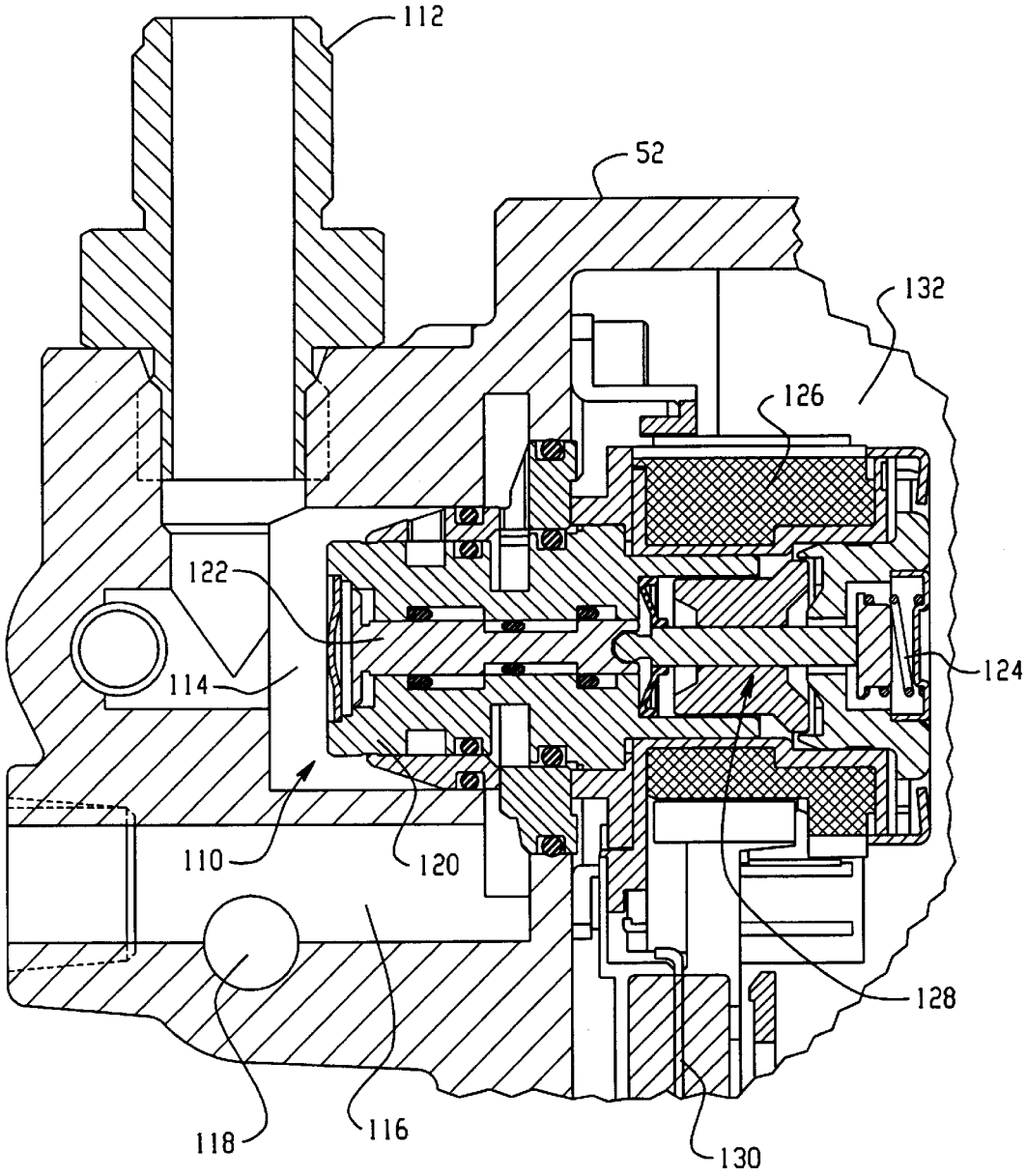
FIG. 4 is an enlarged, fragmentary, axial cross-section taken on line 4—4 of FIG. 2, and showing primarily the control valve assembly for controlling the clutch assembly of the present invention.

Referring now primarily to FIG. 4, there is illustrated a control valve assembly, generally designated 110, of the type which may be used to control the pressure in the chamber 106. It will be understood by those skilled in the art, that the invention of this application is not limited to any particular type or configuration of control valve, or to any particular control logic. What is essential to the present invention is merely that the clutch assembly include some sort of control valving which is capable of modulating the pressure in the chamber 106 between the relatively high and relatively low pressures to achieve engagement and disengagement of the clutch pack 84 within the specified response times.

Disposed in threaded engagement with the clutch housing 52 is a fitting 112 (see also FIG. 2), which is connected to a source of fluid pressure, such as the engine lubrication fluid, as was described previously. The clutch housing 52 also defines a chamber 114 in which is disposed the control valve assembly 110 The housing 52 also defines an axial passage 116 communicating with a transverse passage 118, which is in open communication with the pressure chamber 106.

The control valve assembly 110, which will be described only briefly hereinafter, may be of the general type illustrated and described in U.S. Pat. No. 4,947,893, assigned to the assignee of the present invention, and incorporated herein by reference. The control valve assembly 110 includes a valve body 120 and disposed for axial movement therein, a valve spool 122, the valve spool 122 being shown in FIG. 4 in a centered (or "neutral" position). The valve spool 122 is biased to the left in FIG. 4 by a compression spring 124, and can be moved to the right in FIG. 4 by means of an electromagnetic coil 126 which, when energized, biases an armature assembly 128 to the right, moving the valve spool 122 to the right also.

In operation, with the coil 126 de-energized, the spring 124 biases the valve spool 122 to the left in FIG. 4, permitting communication of pressure from the chamber 114 through the valve assembly 110 to the axial passage 116, thus pressurizing the chamber 106, such that the piston 76 moves to the right in FIG. 3, disengaging the clutch pack 84, in the manner described previously. The above-described arrangement whereby the coil 126 is de-energized to disengage the clutch pack 84 is preferred because, in a typical vehicle application, the supercharger is disengaged for a greater part of the total duty cycle than it is engaged. More importantly, it is considered desirable that an electrical failure result in the supercharger clutch being disengaged.

When it is desired to operate the supercharger, by engaging the clutch pack 84, an appropriate electrical signal 130 is transmitted to the coil 126, moving the valve spool 122 to the right of the position shown in FIG. 4, thus communicating the passage 116 (and therefore, the chamber 106) through the valve assembly 110 to a case drain region, illustrated generally as 132 in FIGS. 3 and 4. The decreasing pressure in the chamber 106 permits the springs 104 to bias the release plate 98 to the left, to the position shown in FIG. 3, as described previously, engaging the clutch pack 84. The rate of engagement (response time) of the clutch pack is determined by the pressure in the chamber 106, which in turn is controlled in response to changes in the electrical signal 130, such that a "soft engagement" may be achieved when that is desirable, or a more rapid engagement may be achieved when that is need and is acceptable. Those skilled in the art will understand that in most supercharger installations, it is the engagement response time which is more critical, whereas the disengagement response time is typically less critical.

Figure 5:
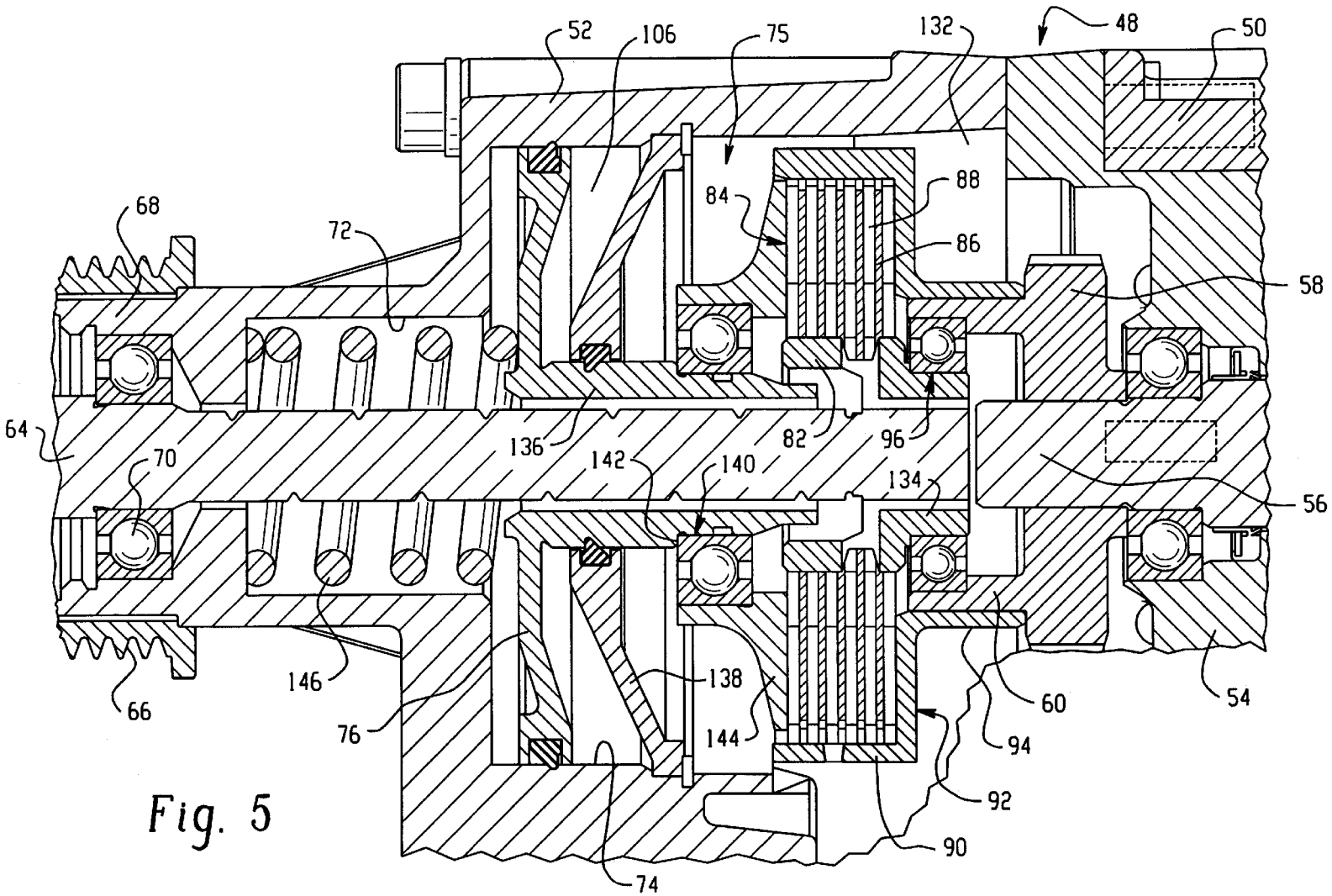
FIG. 5 is an enlarged, fragmentary, axial cross-section similar to FIG. 3, and on approximately the same scale, illustrating an alternative embodiment of the clutch assembly of the present invention.

Referring now primarily to FIG. 5, an alternative embodiment of the clutch assembly 75 will be described, in which the same or similar elements bear the same reference numeral, and new, or substantially modified portions of elements bear reference numerals in excess of "132". Whereas the embodiment of FIG. 3 is especially suited for applications in which axial length must be minimized, the embodiment of FIG. 5 is especially suited for applications in which the length is less of an issue, but overall diameter must be minimized.

In the FIG. 5 embodiment, the rearward end (right end in FIG. 5) of the input shaft 64 is either splined or press-fit within a reduced diameter portion 134 of the drive member 82, with the bearing set 96 being disposed radially between the portion 134 and the input hub 60. The clutch piston 76 includes a generally cylindrical portion 136 surrounding the central portion of the input shaft 64, the portion 136 in turn being surrounded by a partition member 138 and by a bearing set 140. The bearing set 140 is disposed against a shoulder 142 formed on the cylindrical portion 136, such that axial movement of the piston 76 will result in axial movement of the bearing set 140. Disposed about the bearing set 140, and adjacent the clutch pack 84 is a wall portion 144.

Surrounding the input shaft 64 is a single coil compression spring 146, seated to bias the piston 76 to the right in FIG. 5, toward the engaged position, as shown. In the absence of relatively high pressure (as that term was explained previously) in the chamber 106, the spring 146 will bias the piston 76 and, through the cylindrical portion 136, will bias the bearing set 140 and wall portion 144 to apply sufficient loading to the clutch pack 84. When the pressure in the chamber 106 is increased, the piston 76 is biased to the left in FIG. 5, overcoming the force of the spring 146, and relieving the loading on the clutch pack 84 enough that the clutch assembly 75 operates in the disengaged condition. Within the scope of the present invention, the controls for the alternative embodiment of FIG. 5 could be substantially the same as for the primary embodiment of FIG. 3, to achieve the same sort of modulation of engagement and response time.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A rotary blower of either the backflow or compression type comprising a housing assembly including a main housing and a clutch housing, said main housing defining a blower chamber; blower rotor assemblies disposed in said blower chamber for effecting transfer of volumes of fluid in response to rotation of an input shaft; one of said blower rotor assemblies being operably mounted on a rotor shaft and having an input portion disposed adjacent said input shaft; and a clutch assembly disposed in said clutch housing and in driven relationship with said input shaft, and in driving relationship with said input portion, said clutch assembly being selectively operable between an engaged condition, operable to transmit torque from said input shaft to said input portion, and a disengaged condition; said clutch assembly including a first set of clutch discs fixed for rotation with said input shaft and a second set of clutch discs fixed for rotation with a clutch cage which is fixed for rotation with said input portion; stationary biasing means normally biasing said first and second sets of clutch discs toward said engaged condition; a stationary piston member cooperating with said clutch housing to define a pressure chamber, said piston member being axially moveable, in response to the presence of relatively high pressure fluid in said pressure chamber to a position releasing said biasing means and permitting said clutch assembly to move to said disengage d condition; characterized by:

(a) said clutch cage including a cylindrical portion fixed for rotation with said input portion while being axially moveable relative thereto;

(b) said stationary biasing means including a plate member disposed axially adjacent said clutch cage and a spring member disposed to bias said plate member toward said clutch cage; said plate member including a cylindrical portion; and (c) a bearing set disposed radially between said cylindrical portion of said clutch cage and said cylindrical portion of said plate member, whereby an axial clutch loading force transmitted to said plate member by said spring is transmitted by said p late member through said bearing set to said clutch cage, thus loading said clutch assembly, without the occurrence of sliding rotary engagement between stationary and rotating members.

2. A rotary blower as claimed in claim 1, characterized by said one of said blower rotors including a timing gear mounted on said rotor shaft (56), said timing gear including said input portion.

3. A rotary blower as claimed in claim 1, characterized by said clutch assembly including a clutch cage having a generally cylindrical portion disposed in surrounding relationship to said clutch discs and fixed for rotation with said second set of clutch discs.

4. A rotary blower as claimed in claim 3, characterized by said biasing means comprises a set of coil, compression springs disposed in a generally annular pattern about an axis of rotation defined by said input portion, and said plate member being operable to transmit the force of each of the coil, compression springs into an axial biasing force operable to move said first and second sets of clutch discs toward said engaged condition.

5. A rotary blower as claimed in claim 4, characterized by said piston member and said biasing means being disposed on axially opposite sides of said first and second sets of clutch discs, said piston member including a generally cylindrical portion disposed in surrounding relationship to said generally cylindrical portion of said clutch cage, said generally cylindrical portion of said piston member being in engagement with said plate member, whereby axial movement of said piston member in response to the presence of relatively high pressure fluid in said pressure chamber is transmitted through said generally cylindrical portion of said piston member to said plate member, compressing said coil, compression springs and permitting said clutch assembly to move to said disengaged condition.

* * * * *